United States Patent [19]

Hiraki et al.

[11] Patent Number: 4,993,511

[45] Date of Patent: Feb. 19, 1991

[54] SPEAKER

[75] Inventors: Takayuki Hiraki; Hideaki Kurata; Tetsuya Kamata; Eiji Shintani, all of Tokyo, Japan

[73] Assignee: Pioneer Electronic Corporation, Tokyo, Japan

[21] Appl. No.: 468,660

[22] Filed: Jan. 23, 1990

[30] Foreign Application Priority Data

Apr. 10, 1989 [JP] Japan ..... 1-41798[U]

[51] Int. Cl.[5] ..... H04R 1/02

[52] U.S. Cl. ..... 181/150; 181/175; 381/188; 381/205

[58] Field of Search ..... 181/141, 150, 171, 172, 181/175; 381/188, 86, 97, 159, 193, 205

[56] References Cited

U.S. PATENT DOCUMENTS

| | | | |
|---|---|---|---|
| 3,716,671 | 2/1973 | Karr | 181/150 X |
| 4,277,653 | 7/1981 | Pawelzick | 381/86 X |
| 4,289,929 | 9/1981 | Hathaway | 381/97 X |
| 4,602,382 | 7/1986 | Gabbay et al. | 381/159 |
| 4,853,966 | 8/1989 | Skrzycki | 181/150 X |
| 4,891,842 | 1/1990 | Green | 381/188 |

*Primary Examiner*—Benjamin R. Fuller

*Attorney, Agent, or Firm*—Sughrue, Mion, Zinn, Macpeak & Seas

[57] ABSTRACT

A speaker including a speaker unit, a speaker frame for supporting the speaker unit and a grille unit for covering the speaker frame. The grille unit is bolted to the speaker frame by bolts, and the grille unit includes flaps for covering head portions of the bolts used for bolting the grille unit to the speaker frame.

9 Claims, 2 Drawing Sheets

SPEAKER

FIELD OF THE INVENTION

The present invention relates to speakers, and more particularly, relates to a speaker having a speaker frame.

BACKGROUND OF THE INVENTION

Most of the speakers presently available include a speaker frame having a plurality of bolt holes formed in the circumference thereof. The speaker frame is fixed with bolts to a baffle plate or a member constituting a door of a vehicle, and a grille is attached to the speaker frame.

For example, referring to FIG. 3, a grille 3 having a decorative net 3A stretched thereover is fitted to a rim portion 2A formed on the circumferential edge portion of a speaker frame 2 of a speaker unit 1.

Referring to FIG. 4, when a grille 3 is attached to a speaker frame 2, the grille 3 is fastened to the speaker frame 2 when a speaker is attached to a car-body member. Further, as shown in FIG. 5, there is a case where a grille 3 having no decorative net is fastened to speaker frame 2 so as to be attached thereto, and then a decorative net 3A is bonded to the grille 3.

In the above-mentioned speakers shown in FIGS. 3–5, when attaching a speaker, it is necessary to attach a grille or a decorative net to the grille, and in some cases, speaker head portions of bolts used for attaching the speaker are exposed on the surface. In a speaker in which bolt head portions are not exposed, there are problems in that it is necessary to provide a rim at the circumference of a speaker frame so that the grille can be fitted to the rim. Further, the speaker frame is complicated in shape, and the fitted frame often pops out by vibrations or the like of the vehicle.

SUMMARY OF THE INVENTION

It is therefore an object of the present invention to provide a speaker in which it is not necessary to provide a rim at the circumference of the speaker and in which head portions of bolts used for attaching the speaker are covered, thereby improving the appearance of the speaker.

It is another object of the invention to provide a speaker in which a grille portion is securely fixed to the speaker by bolts and in which head portions of the bolts are not exposed.

In order to attain the objects as described above, a speaker according to the present invention includes a member to which the speaker is attached and a speaker frame having a flange portion which is attached to the member with bolts.

The speaker frame includes a grille unit for covering the front surface of the speaker frame including the flange portion, the grille unit being provided with an annular rim which follows the flange portion, the rim having recess portions corresponding to holes of the bolts and being provided with flaps connected to the rim through hinges so as to cover the head portions of the bolts.

In attaching the speaker, the flaps provided on the grille are opened to fasten the bolts, and the flaps are closed so as to cover the head portions of the bolts after the bolts have been fastened, so that the head portions of the bolts are not exposed.

DETAILED DESCRIPTION OF THE PREFERRED EMBODIMENT

Figure 1:
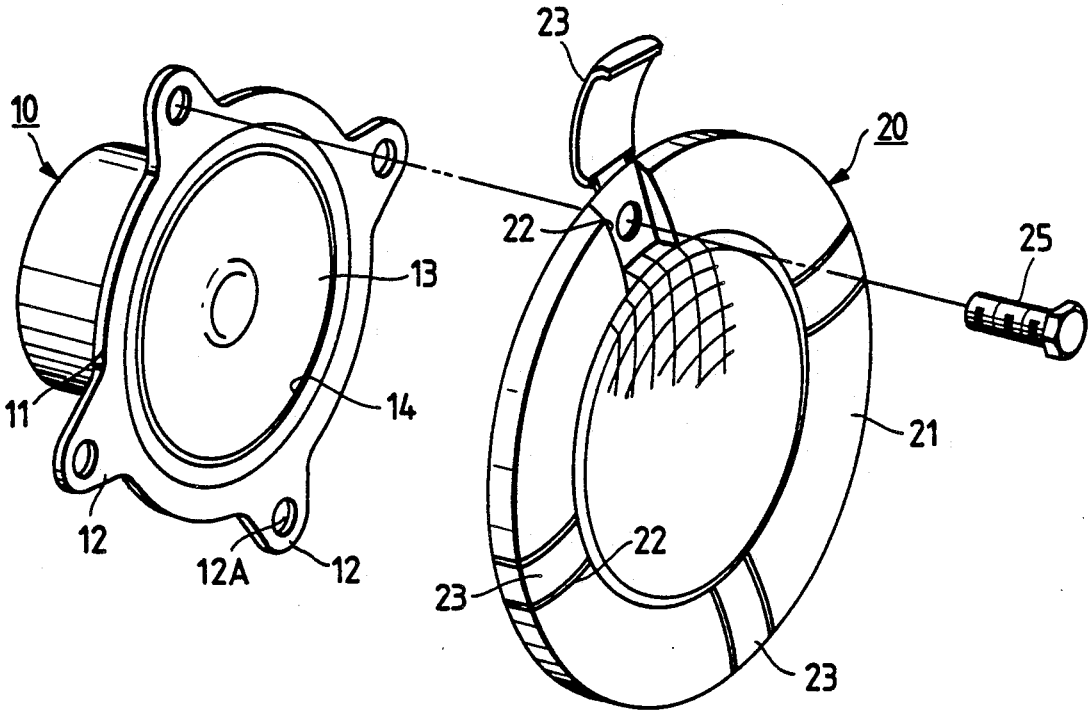
FIG. 1 is an exploded perspective view of the speaker according to the present invention.
Figure 2:
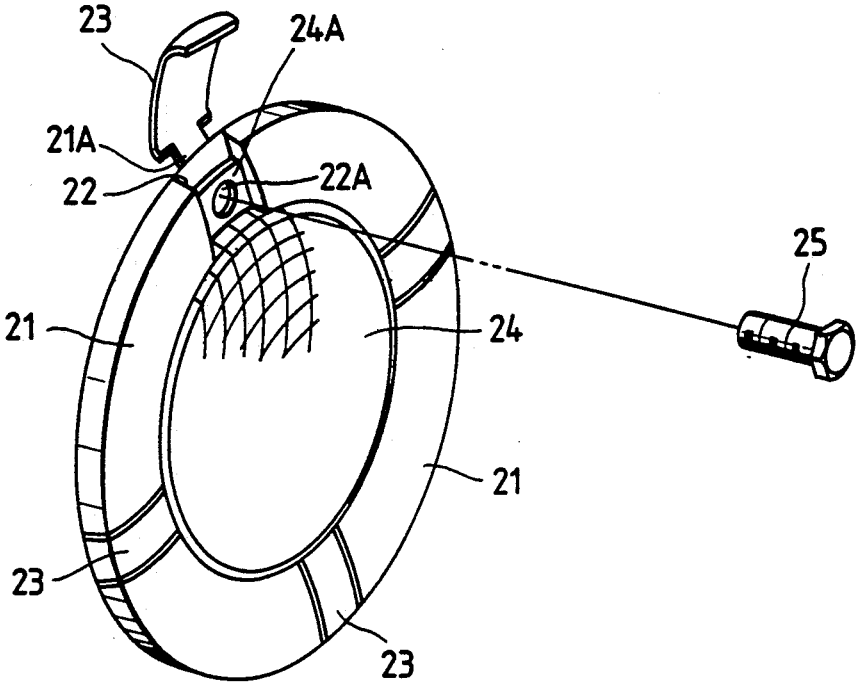
FIG. 2 is a perspective view of a grille unit according to the present invention.
Figure 3:
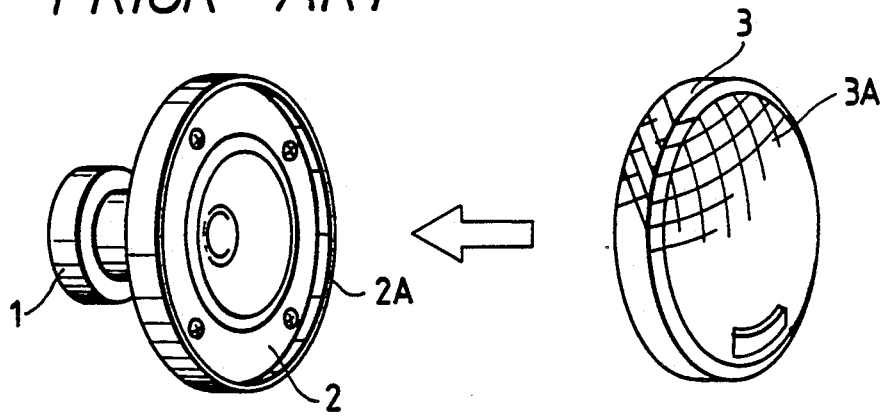
FIG. 3 PRIOR ART
FIGS. 3 through 5 are exploded perspective views of conventional speakers.
Figure 4:
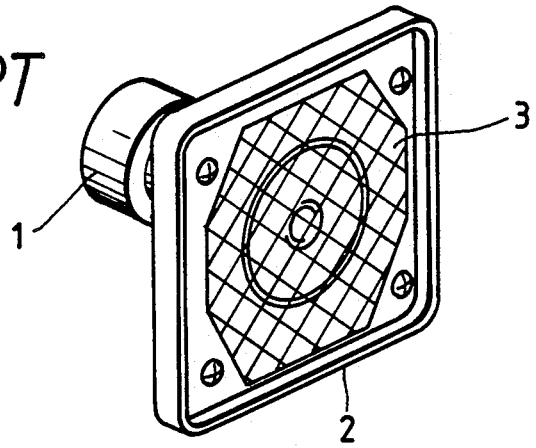
FIG. 4 PRIOR ART
Figure 5:
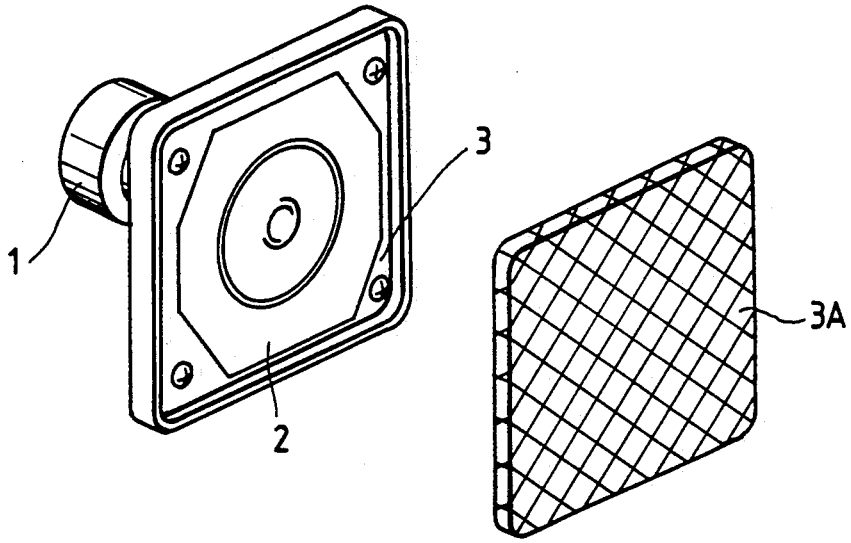
FIG. 5 PRIOR ART

Referring to FIGS. 1 and 2, an embodiment of the speaker according to the present invention will be described. In FIGS. 1 and 2, the reference numeral 10 designates a speaker unit, and 20 designates a grille unit for covering the speaker unit 10. The speaker unit 10 has bolt seats 12 provided on a speaker frame 11 at its four circumferential portions thereof, and holes 12A are formed in the bolt seats 12 respectively.

The grille unit 20 is formed so as to cover the front surface of the speaker frame 11. The grille unit 20 has a central hole having a diameter which is sufficient to include a diaphragm 13 and an edge 14 therein, and a rim 21 is formed at the circumference of the central hole. The rim 21 has a diameter which is sufficient to cover the bolt seats 12 of the speaker frame 11, and recess portions 22, at which the rim 21 is made thin, are formed with the same intervals as those of the bolt seats 12. As shown in FIG. 2, holes 22A are formed in each of the recess portions 22, and flaps 23 are formed of the same material as that of the rim portion 21 and are attached through hinge portions 21A integrally formed with the rim 21 at the outer edges thereof so that the flaps 23 can be snap-engaged with the inner circumferential edge of the rim 21, thereby covering the recess portions 22.

A decorative net 24 is stretched over the central hole surrounded by the rim 21, and the circumferential edge of the decorative net 24 forms a flange portion 24A on the rim 21. Referring to FIGS. 1 and 2, the grille unit 20, the speaker unit 10, and the decorative net 24 are simultaneously fastened together with bolts 25 extending through the holes 22A and 12A.

After the speaker unit 10 and the grille unit 20 have been fixed by the bolts 25 to a member to which those units are to be attached, the flaps 23 are closed so that the head portions of the bolts 25 appear to be covered by the rim 21. However, in fact, the rim 21 is bolted to the speaker frame 21 by the bolts 25.

In conclusion, the speaker according to the present invention is configured in such a manner that the grille unit 20 is fastened together with the speaker unit 10 by means of the bolts 25 for attaching the speaker unit. The thin recess portions 22 are formed in the rim 21 of the grille unit 20 at positions corresponding to the bolts 25, and the flaps for covering the recess portions 22 are connected through hinges 21A. Accordingly, the head portions of the bolts 25 are covered by the flaps 23 so that the appearance of the attached speaker is improved, while at the same time the rim 21 including the decorative net 24 are secured bolted to the speaker frame 11.

What is claimed is:

1. A speaker comprising:

a speaker unit;

a speaker frame for holding said speaker unit, said speaker frame having a plurality of holes for receiving respective bolts; and a grille unit for covering a front surface of said speaker frame, said grille unit having a plurality of holes which correspond to the holes of said speaker frame so that said grille unit and said speaker frame can be bolted together by inserting the bolts through the holes of said speaker frame and said grille unit, said grille unit further having a plurality of cover means each disposed adjacent a different one of the grille unit holes, each of said cover means movable between a first position for allowing one of said bolts to be inserted through the adjacent hole, and a second position for covering a head portion of the inserted bolt.

2. The speaker as defined in claim 1, wherein said grille unit includes an annular rim and a net covering a central hole surrounded by said annular rim.

3. The speaker as defined in claim 2, wherein said annular rim includes a plurality of recess portions, and the holes of said grille unit being respectively disposed in the recess portions.

4. The speaker as defined in claim 3, wherein each of said cover means comprises a flap and a hinge, each of said flaps being connected to a different one of the recess portions by a hinge, and each of said flaps covering a respective recess portion including the recess portion hole when said flap is in a closed state.

5. The speaker as defined in claim 1, wherein said speaker frame includes a plurality of bolt seats, said holes of said speaker frame being respectively disposed in the bolt seats.

6. A speaker comprising:

a speaker unit;

a speaker frame for supporting said speaker unit, said speaker frame having holes for receiving bolts; and a grille unit for covering said speaker frame, said grille unit comprising an annular rim having recess portions and holes respectively disposed in the recess portions, the holes of the recess portions corresponding to the holes of said speaker frame so that said grille unit is bolted to said speaker frame when bolts are inserted through the holes of said grille unit and said speaker frame, said grille unit further comprising a plurality of flaps, each of said flaps being hinged to said annular rim at positions thereof so that each of said flaps covers a different one of the recess holes when in a closed state.

7. The speaker as defined in claim 6, further comprising a net, said annular rim defining a central rim hole, and said net covering said rim hole.

8. The speaker as defined in claim 7, wherein said net also covers the recess portions of said annular rim but not the holes of said recess portions.

9. The speaker as defined in claim 6, wherein said speaker unit includes a diaphragm, and said speaker frame surrounds said diaphragm.

* * * * *